US011638445B2

(12) United States Patent
Gambino

(10) Patent No.: US 11,638,445 B2
(45) Date of Patent: May 2, 2023

(54) SMOKING APPARATUS FOR ATTACHMENT TO A BOTTLE

(71) Applicant: Vittorio S. Gambino, Aurora, CO (US)

(72) Inventor: Vittorio S. Gambino, Aurora, CO (US)

( * ) Notice: Subject to any disclaimer, the term of this patent is extended or adjusted under 35 U.S.C. 154(b) by 200 days.

(21) Appl. No.: 16/896,908

(22) Filed: Jun. 9, 2020

(65) Prior Publication Data

US 2021/0378295 A1 Dec. 9, 2021

(51) Int. Cl.

| | |
|---|---|
| ***A24F 1/30*** | (2006.01) |
| ***A24F 3/00*** | (2006.01) |
| ***A24F 5/00*** | (2006.01) |
| ***A24F 7/02*** | (2006.01) |

(52) U.S. Cl.

CPC ..... *A24F 3/00* (2013.01); *A24F 1/30* (2013.01); *A24F 5/00* (2013.01); *A24F 7/02* (2013.01)

(58) Field of Classification Search

None

See application file for complete search history.

(56) References Cited

U.S. PATENT DOCUMENTS

| | | | | |
|---|---|---|---|---|
| 10,226,071 | B2 | 3/2019 | Nagel | |
| 2009/0084391 | A1 | 4/2009 | Krupp | |
| 2010/0126516 | A1* | 5/2010 | Yomtov | A24F 1/30 29/401.1 |
| 2014/0144452 | A1 | 5/2014 | Liu et al. | |
| 2016/0095351 | A1 | 4/2016 | Carrion | |
| 2016/0295911 | A1 | 10/2016 | Kalousek et al. | |
| 2018/0020718 | A1 | 1/2018 | Thoede, Jr. | |
| 2019/0320712 | A1 | 10/2019 | Rix et al. | |

FOREIGN PATENT DOCUMENTS

| | | | |
|---|---|---|---|
| CA | 2561331 | A1 | 3/2008 |
| CN | 203234031 | U | 10/2013 |

OTHER PUBLICATIONS

International Application No. PCT/US21/35661, International Search Report and the Written Opinion of the International Searching Authority, or the Declaration dated Sep. 17, 20210 (10 Pages).

Four different screenshots of a same product from the same page https://www.waxmaidstore.com/products/waxmaid-8-universal-traveler-water-bottle-pipe/www.WaxMaidStore.com, downloaded on Jul. 6, 2022 (4 Pages).

* cited by examiner

*Primary Examiner* — Kelly M Gambetta
*Assistant Examiner* — Katherine A Will
(74) *Attorney, Agent, or Firm* — Lawrence N. Ginsberg

(57) ABSTRACT

A smoking apparatus for attachment to a bottle includes a main base, a downstem element, and a mouthpiece assembly. The main base includes an upper and a lower portion. The upper portion includes a bowl receiving port configured to be attached to a bowl for containing smokable material, a smoke inlet conduit for providing passage of smoke between the bowl receiving port and a downstem element insertion port formed within the main base, a mouthpiece receiving port configured to be attached to a mouthpiece assembly, and a smoke outlet conduit for providing passage of smoke from an upper section of the bottle to the mouthpiece receiving port. The lower portion includes a flexible material configured to provide a force fit relationship with a bottle. The downstem element is configured to be attached within the downstem element insertion port. The downstem element is configured to extend into the bottle during use.

17 Claims, 4 Drawing Sheets

SMOKING APPARATUS FOR ATTACHMENT TO A BOTTLE

BACKGROUND OF THE INVENTION

1. Field of the Invention

The present invention relates generally to a smoking apparatus and, more particularly to a smoking apparatus which is easily and efficiently connectable to a bottle.

2. Description of the Related Art

Users of water pipes, hookahs, etc. are often faced with issues of portability and fragility. They are often large, oblong, and with a heavy glass base. Typical water pipes and hookahs deal with limitations in use and portability due to the size and weight of the apparatus.

The above mentioned apparatus are very breakable and expensive to replace being they are typically only offered for purchase as a full unit and not as separate accessories. This results in relatively high costs.

When using a pipe, the smoke from the smokable material can be inhaled at hot temperatures, depending on the size of the pipe. Since pipes are also reusable, if the pipe is not properly cleaned after every use then the user can inhale previously burnt carcinogens along with the new burnt smokable material, leading to undesirable risks. Further, smoke from pipes is often wasted into the atmosphere between inhalations, and undesirable debris and/or residue from the smokable material may be inhaled through the pipe when there is no substantial filter.

In standard use, each of these apparatus mentioned above would also need to be purchased separately as individual pieces, not only furthering the user's expense, but also the amount of equipment that would be needed to be lugged around when transporting.

In partial response to the problems discussed above, U.S. Pat. No. 10,226,071 B2, entitled Apparatus for Securing to The Top of a Bottle or Canister for Providing a Smoking Assembly, issued on Aug. 17, 2017, discloses a smoking apparatus and assembly that may be used with a variety of standard sized bottles, which utilizes a disposable straw and bowl. The '071 device sits on top of the bottle or canister. The device and its use are relatively flimsy.

U.S. Publication No. 2016/0095351 A1, entitled Hydro Puff, published on Apr. 7, 2016, discloses various embodiments of a portable puff device comprising a stem, a mouth piece and a filter band. The stem is a tubular structure with a cone or cup shaped holder fixed to one end. The mouth piece is hollow structure comprising a screw structure to be fixed over a mouth of a bottle. The mouth piece comprises an angularly attached puffing pipe. A placement of the puffing pipe is above the mouth of the bottle to allow a flow of air or smoke. The filter band is attached at a junction of the conical holder of the stem and a top portion of the mouth piece. The stem is inserted into the mouth piece and is firmly fitted to the mouth piece through the filter band with conical holder lying above a top portion of the mouth piece. The '351 device hinders a cool smoke. Smoke comes up and is reheated because it is in proximity with the mouthpiece. Neither the '071 device nor the '351 device effectively provide a cool, clean smoke.

As will be disclosed below the present invention obviates these and other problems with waterpipes, hookahs and alike by providing a smoking apparatus which is easily connectable to a commercially used bottle, such a wine bottle, beverage bottle, etc.

SUMMARY OF THE INVENTION

In one aspect, the present invention is embodied as a smoking apparatus for attachment to a bottle. The smoking apparatus includes a main base, a downstem element, and a mouthpiece assembly. The main base has a central axis, and includes an upper and a lower portion. The upper portion includes a bowl receiving port configured to be attached to a bowl for containing smokable material, a smoke inlet conduit for providing passage of smoke between the bowl receiving port and a downstem element insertion port formed within the main base, a mouthpiece receiving port configured to be attached to a mouthpiece assembly, and a smoke outlet conduit for providing passage of smoke from an upper section of the bottle to the mouthpiece receiving port. The lower portion depends from the upper portion and comprises a flexible material configured to provide a force fit relationship with a bottle. The downstem element is configured to be attached within the downstem element insertion port. The downstem element is configured to extend into the bottle during use. The mouthpiece assembly is configured to be attached to the mouthpiece receiving port.

In another aspect the present invention is embodied as a method for inhaling smokable material including the steps of providing parts of a smoking apparatus, connecting the various parts, and inserting the assembled smoking apparatus in the top opening of the bottle.

BRIEF DESCRIPTION OF THE DRAWINGS

The same elements or parts throughout the figures of the drawings are designated by the same reference characters, while equivalent elements bear a prime designation.

DETAILED DESCRIPTION OF THE INVENTION

Figure 1:
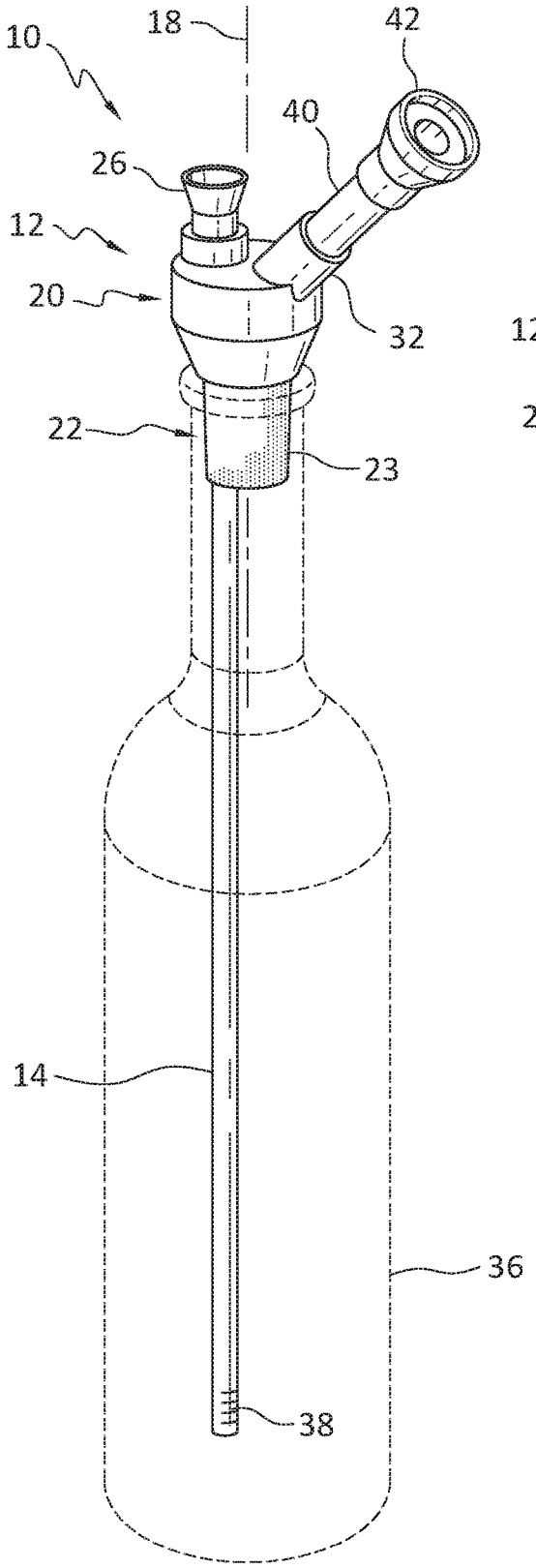
FIG. 1 is a perspective illustration of a first embodiment of the smoking apparatus of the present invention.
Figure 2:
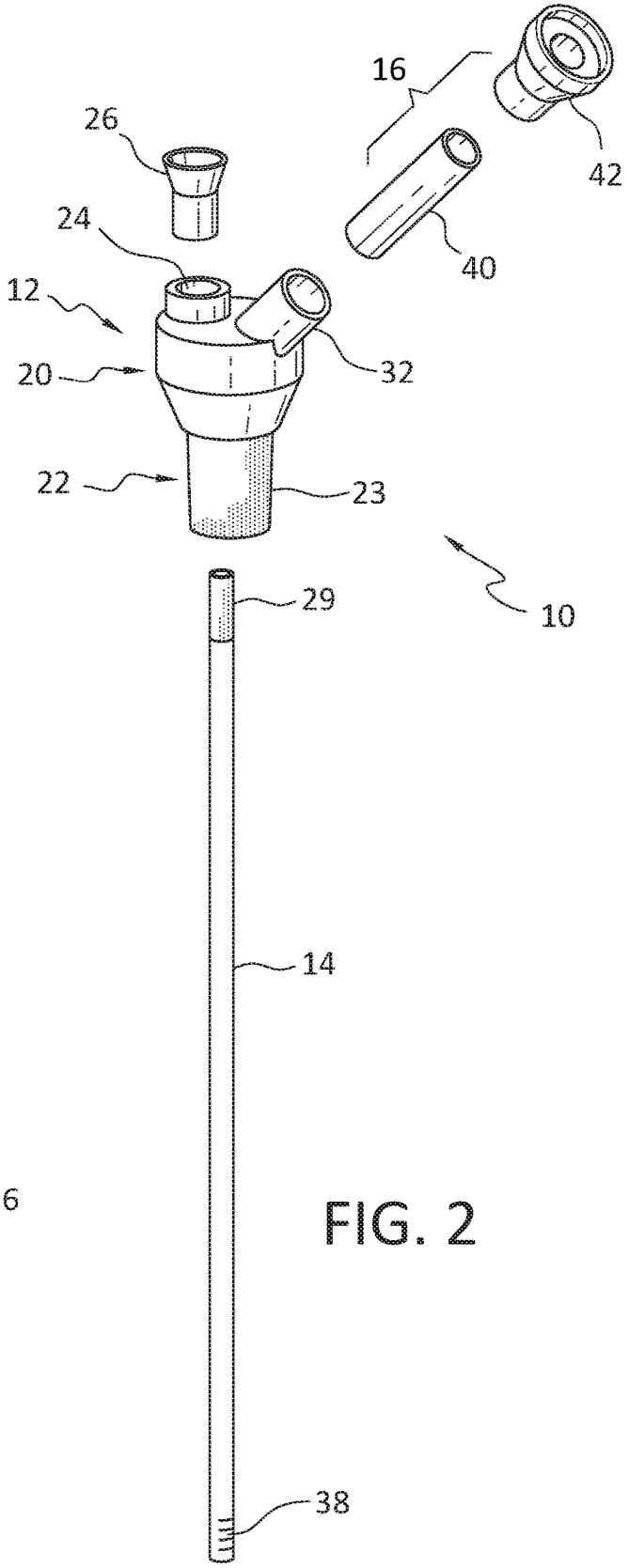
FIG. 2 is an exploded perspective view of the embodiment shown in FIG. 1.
Figure 3:
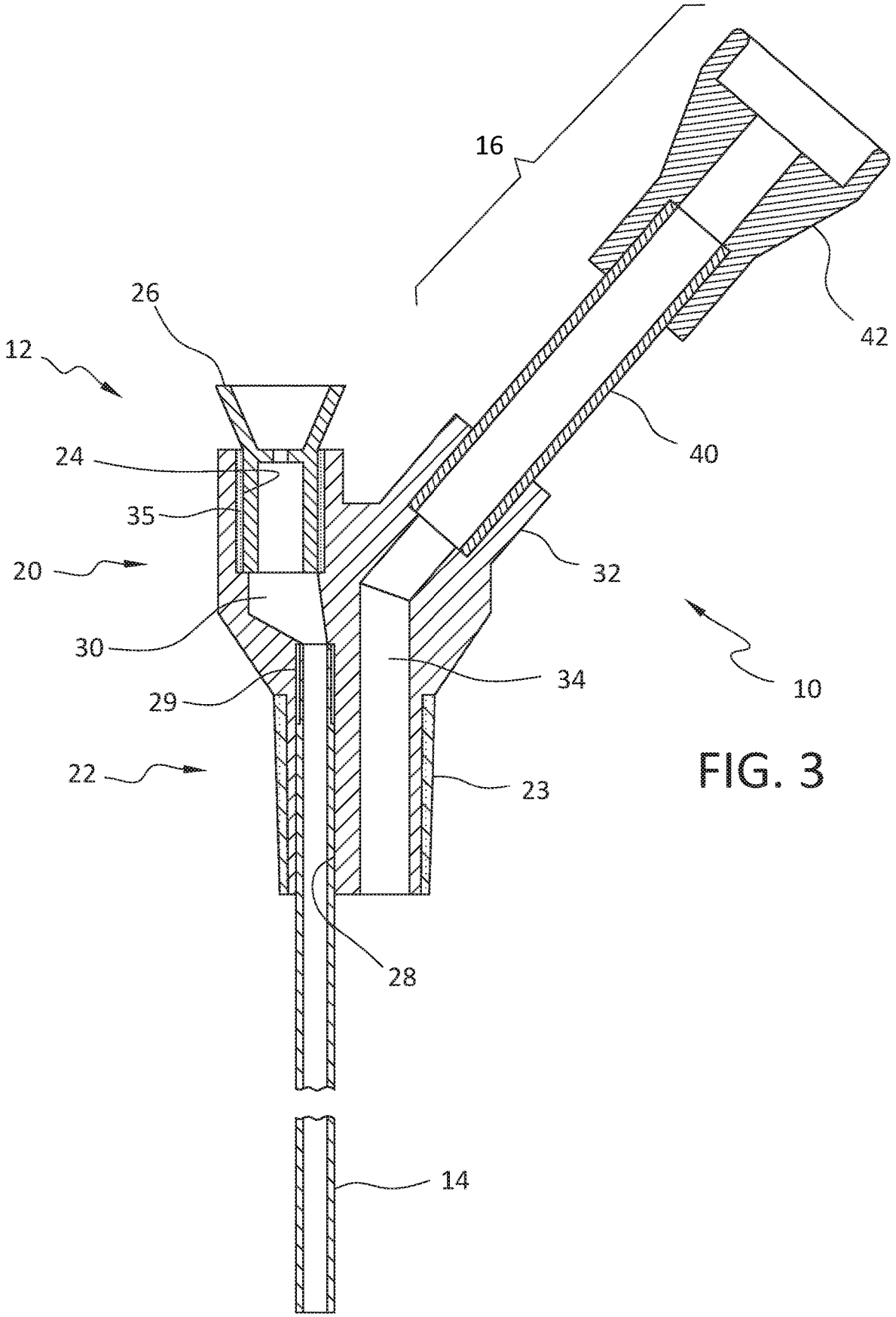
FIG. 3 is a view taken along line 3-3 of FIG. 1.

Referring now to the drawings and the characters of reference marked thereon, FIGS. 1-6 show a preferred embodiment of the smoking apparatus of the present invention, designated generally as 10. The smoking apparatus 10 includes a main base 12, a downstem element 14, and a mouthpiece assembly 16.

The main base 12 includes a main base central axis 18. The main base 12 includes an upper portion, designated generally as 20; and, a lower portion, designated generally as 22. The upper portion 20 includes a bowl receiving port 24 configured to be attached to a bowl 26 for containing smokable material. The upper portion 20 also includes a smoke inlet conduit 30; a mouthpiece receiving port 32; and, a smoke outlet conduit 34. The smoke inlet conduit 30 provides passage of smoke between the bowl receiving port 24 and a downstem element insertion port 28 formed within the main base 12. The mouthpiece receiving port 32 is configured to be attached to the mouthpiece assembly 16. The smoke outlet conduit 34 provides passage of smoke from an upper section of the bottle to the mouthpiece receiving port. The main base is preferably formed of acrylic plastic or other resilient suitable materials such as glass. A bowl receiving port insert 35 is preferably positioned between the bowl receiving port 24 and a bowl 26 to secure a desired bowl 26 selected from various sizes. The bowl receiving port insert 35 also acts as an insulator to insure the heat is controlled to be in the bowl and not transferred to other parts of the smoking apparatus 10.

The lower portion 22 of the main base 12 depends from the upper portion 20 and includes a flexible material configured to provide a force fit relationship with a bottle 36. In the embodiment shown in FIG. 3 the lower portion 22 includes a lower portion sleeve 23, which may be formed of material such as silicone. In some embodiments the lower portion 22 may not be required to include the lower portion sleeve 23. Other suitable materials may be utilized to provide the flexibility for a force fit as known by those skilled in the art. The lower portion 22 may be tapered to accommodate various bottle diameters. Different sizes may be used. For example, in one embodiment, a diameter at the upper end of the lower portion 22 has a diameter of 2.5 cm and the lower end of the lower portion 22 tapers to 1.9 cm. This size is appropriate for wine bottles and the like. In some embodiments the lower portion 22 may include a substantially smooth outer surface; however, in other embodiments it may have a ridged outer surface to enhance the force fit.

The downstem element 14 is configured to be attached within the downstem element insertion port 28 such that the downstem element 14 extends into the bottle 36 during use. The downstem element 14 is preferably removably attached by a force/friction fit. A downstem element sleeve 29 may be utilized inside the lower portion 22, within the downstem element insertion port 28, to function as a secure way to hold the downstem element 14 in place during operation. The downstem element sleeve 29 may be formed of a suitable flexible material, preferably silicone. This attachment method of the downstem element 14 provides ease in storage and interchangeability of parts. The downstem element 14 may include a number of slits 38 for diffusing the smoke. The downstem element 14 is preferably formed of a resilient plastic such as acrylic plastic to provide the force fit, however, other suitable materials can be used.

The mouthpiece assembly 16 is configured to be attached to the mouthpiece receiving port 32. In the embodiment shown in FIGS. 1-3, the mouthpiece receiving port 32 includes a mouthpiece extension 40 including a first end connectable to the mouthpiece receiving port 32 and a second end connectable to a mouthpiece element 42.

In operation of the smoking apparatus 10, when the user inhales from the mouthpiece element 42, smoke from combustion in the bowl 26 passes through the smoke inlet conduit 30, and through the downstem element 14. It then passes up through the liquid in bottle 36, through the lower portion 22, through the smoke outlet conduit 34, and into the mouthpiece assembly 16. Thus, the main base 12 effectively partitions the smoke in the smoke inlet conduit 30 from the smoke in the outlet conduit 34.

The mouthpiece receiving port 32 portion of the main base extends from the main base central axis 18 at an angle of approximately 20-65 degrees. In a preferred embodiment the angle is approximately 50 degrees.

The present invention can include a number of different accessories.

Figure 4A:
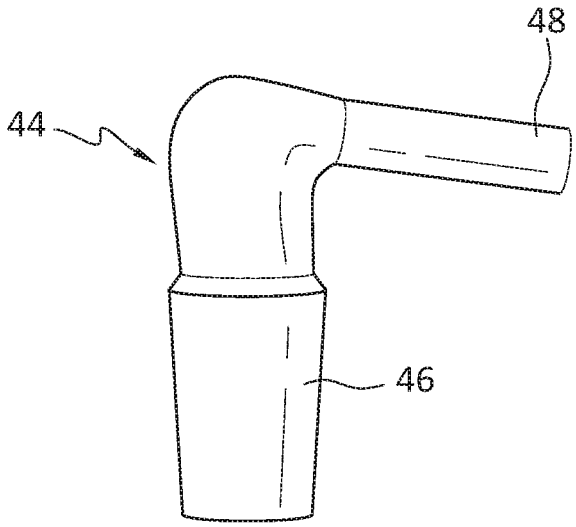
FIG. 4A is a front perspective view of a vape attachment for the smoking apparatus.
Figure 4B:
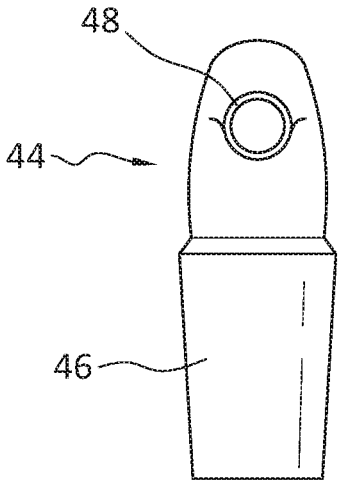
FIG. 4B is a side perspective view of the vape attachment of FIG. 4A.

Referring now to FIGS. 4A and 4B, a vape attachment is illustrated, designated generally as 44. The bottom portion 46 is inserted into the bowl receiving port 24. A vape pen (not shown) is then inserted into the vape receiving port 48.

Figure 5:
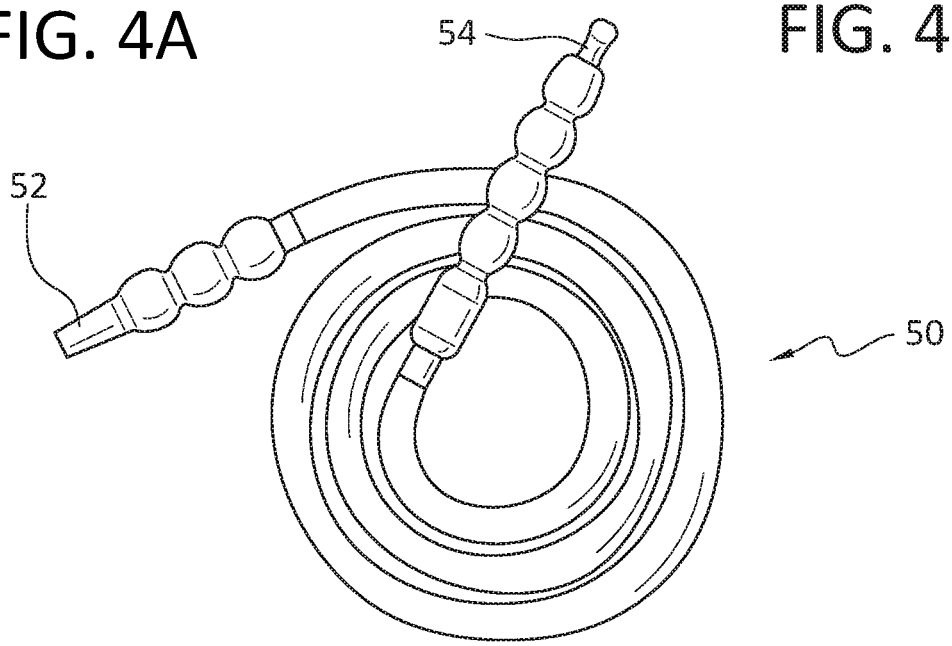
FIG. 5 is a perspective view of a hookah hose accessory of the present invention.

Referring now to FIG. 5, a hookah hose accessory is illustrated, designated generally as 50. One end 52 is inserted to the mouthpiece receiving port 32. The other end contains a hookah mouthpiece (typically with a metal tip) 54 is then used to inhale from.

Figure 6A:
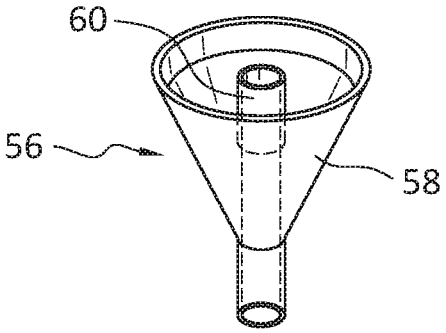
FIGS. 6A and 6B are a perspective view and side view, respectively, of a hookah bowl assembly of the present invention.
Figure 6B:
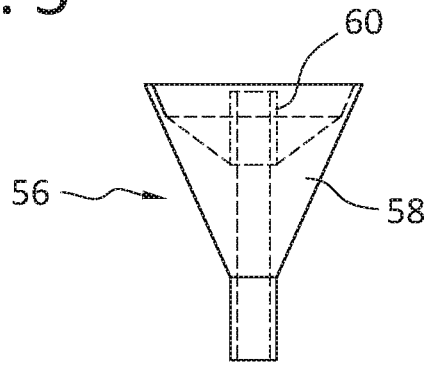

FIGS. 6A and 6B show a hookah bowl assembly, designated generally as 56. The hookah bowl assembly 56 is inserted into the bowl receiving port 24. The hookah smoking substance is placed in the hookah bowl element 58 around the outside of the cylinder 60 in the center which pulls the smoke into the water for filtration. Once heated by the heating element (not shown), the smoke rises, forced down the cylinder 60, and led to the hookah hose for inhalation.

Figure 7A:
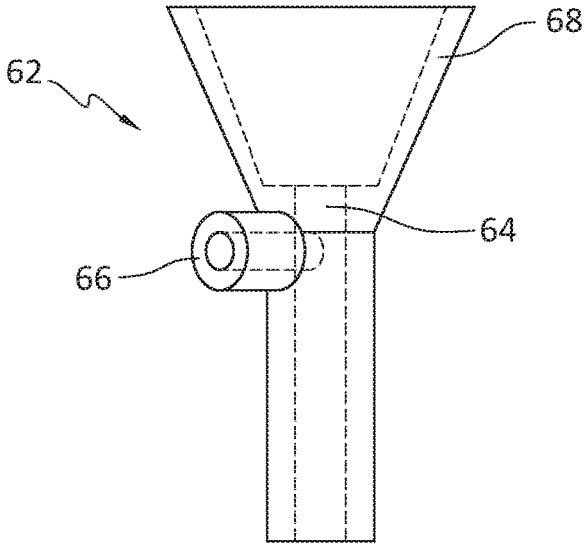
FIG. 7A is a side perspective view of a smokable roll attachment of the present invention.
Figure 7B:
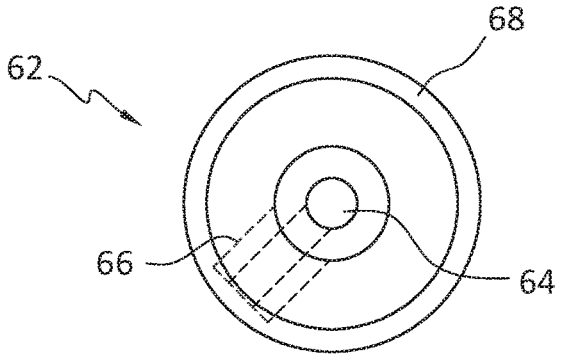
FIG. 7B is a top view thereof.
Figure 7C:
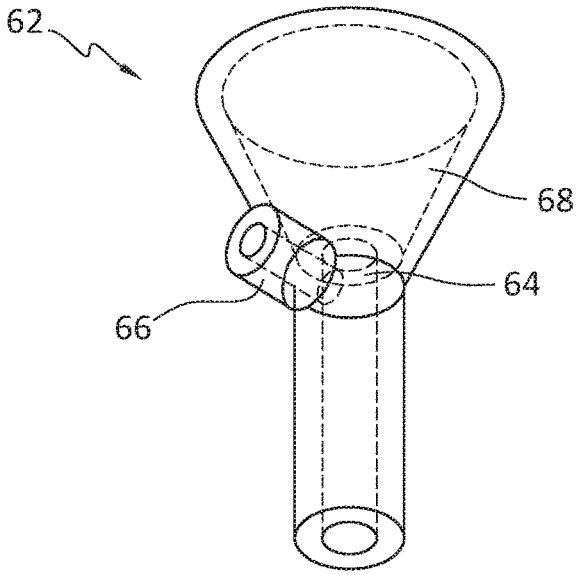
FIG. 7C is a side perspective view thereof.

Referring now to FIGS. 7A-7C a smokable roll attachment is illustrated, designated generally as 62. This is for smoking of plant material that has been rolled or placed into rolling papers. The smokable roll attachment 62 is inserted into the bowl receiving port. A smokable roll is inserted into the center 64 which holds it in place while smoking. A carburetor opening 66 on the side can be covered and released as needed to increase the efficacy of the smoking experience. The smokable roll will stay inserted and the bowl 68 itself will function as an ash catcher.

Figure 8:
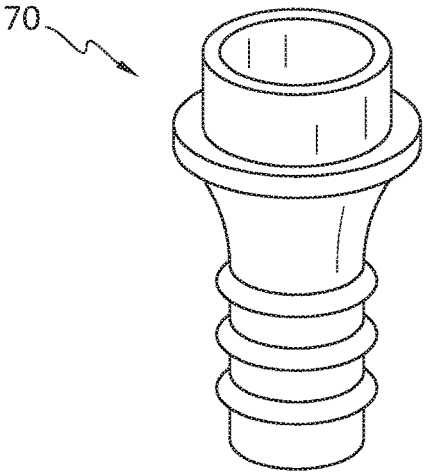
FIG. 8 is view of a bottle insert accessory of the present invention.

FIG. 8 illustrates a bottle insert 70. The bottle insert 70 provides utilization of the smoking apparatus with various sizes of bottles. Such a bottle insert 70 can fit about the lower portion 22. The lower portion of the bottle insert provides the maximum amount of surface area in order to hold the bottle. In order to remove, the user grasps the bottle's neck as well as the bottle insert at its sides and pulls up on the smoking apparatus, while keeping the bottle stationary.

The term "bottle" as used herein is meant to broadly encompass any type of container with an opening on top which can accommodate the main base and with sufficient depth to accommodate the downstem element, as discussed above.

As mentioned above, other embodiments and configurations may be devised without departing from the spirit of the invention and the scope of the appended claims.

The invention claimed is:

1. A smoking apparatus for attachment to a bottle, comprising:

a) a main base having a main base central axis, comprising:

i. an upper portion, comprising:

1. a bowl receiving port configured to be attached to a bowl for containing smokable material;

2. a smoke inlet conduit for providing passage of smoke between said bowl receiving port and a downstem element insertion port formed within the main base;
3. a mouthpiece receiving port configured to be attached to a mouthpiece assembly;
4. a smoke outlet conduit for providing passage of smoke from an upper section of the bottle to the mouthpiece receiving port;

ii. a lower portion depending from said upper portion, said lower portion comprising a flexible material configured to provide a force fit relationship with a bottle;

b) a cylindrical downstem element configured to be attached within said downstem element insertion port, wherein said downstem element is configured to extend into the bottle during use; and, c) a mouthpiece assembly configured to be attached to said mouthpiece receiving port, wherein said cylindrical downstem element is offset from said main base central axis.

2. The smoking apparatus of claim 1, wherein said cylindrical downstem element is configured to be removably attached to said downstem element insertion port.

3. The smoking apparatus of claim 1, wherein said mouthpiece assembly is configured to be removably attached to said mouthpiece receiving port.

4. The smoking apparatus of claim 1, wherein said cylindrical downstem element and the mouthpiece assembly are each detachable from the main base by a force fit to provide ease in storage and interchangeability of parts.

5. The smoking apparatus of claim 1, further comprising a bowl being attachable to said bowl receiving port.

6. The smoking apparatus of claim 1, wherein said lower portion includes a smooth outer surface.

7. The smoking apparatus of claim 1, wherein said lower portion includes a ridged outer surface.

8. The smoking apparatus of claim 1, wherein said mouthpiece receiving port comprises mouthpiece receiving axis angularly positioned from said main base central axis, at an angle of approximately 20-60 degrees.

9. The smoking apparatus of claim 1 wherein said mouthpiece assembly comprises:

a. a mouthpiece element; and b. a mouthpiece extension including a first end connectable to said mouthpiece receiving port and a second end connectable to said mouthpiece element.

10. The smoking apparatus of claim 1, wherein said cylindrical downstem element comprises a plurality of slits in a lower portion thereof for diffusing smoke exiting said downstem element.

11. The smoking apparatus of claim 1, further including a bowl receiving port insert positionable between the bowl receiving port and a bowl.

12. The smoking apparatus of claim 1, further including a downstem element sleeve positionable between the downstem element insertion port and the downstem element.

13. The smoking apparatus of claim 1, further including a lower portion sleeve positioned around the lower portion.

14. The smoking apparatus of claim 1, further including a vape attachment configured to be inserted into the bowl receiving port.

15. The smoking apparatus of claim 1, further including a smokable roll attachment configured to be inserted into the bowl receiving port.

16. The smoking apparatus of claim 1, further including a bottle insert configured to fit about said lower portion.

17. A method for inhaling smokable material, comprising the steps of:

a) providing parts of a smoking apparatus, said parts of said smoking apparatus comprising:

i. a main base having a main base central axis, comprising:

1. An upper portion, comprising:

a. a bowl receiving port configured to be attached to a bowl for containing smokable material;

b. a smoke inlet conduit for providing passage of smoke between said bowl receiving port and a downstem element insertion port formed within the main base;

c. a mouthpiece receiving port configured to be attached to a mouthpiece assembly;

d. a smoke outlet conduit for providing passage of smoke from an upper section of the bottle to the mouthpiece receiving port;

2. A lower portion depending from said upper portion, said lower portion comprising a flexible material configured to provide a force fit relationship with a bottle;

ii. a cylindrical downstem element configured to be attached within said downstem element insertion port, wherein said downstem element is configured to extend into the bottle during use;

iii. a mouthpiece assembly configured to be attached to said mouthpiece receiving port; and, iv. a bowl being attachable to said bowl receiving port; wherein said cylindrical downstem element is offset from said main base central axis, b) connecting the cylindrical downstem element, said mouthpiece assembly and said bowl to said main base, thus providing an assembled smoking apparatus;

c) inserting the assembled smoking apparatus in the top opening of the bottle so that the downstem element is positioned within the bottle and the lower portion of the main base is friction fit within said top opening;

d) placing smokable material within said bowl; and, e) smoking said smoking material.

* * * * *